US007132916B2

(12) United States Patent
Maekawa et al.

(10) Patent No.: US 7,132,916 B2
(45) Date of Patent: Nov. 7, 2006

(54) IGNITION COIL

(75) Inventors: Toshio Maekawa, Tokyo (JP); Shigemi Murata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 88 days.

(21) Appl. No.: 10/913,453

(22) Filed: Aug. 9, 2004

(65) Prior Publication Data

US 2005/0134416 A1 Jun. 23, 2005

(30) Foreign Application Priority Data

Dec. 17, 2003 (JP) ..... P.2003-419294

(51) Int. Cl.
*H01F 27/02* (2006.01)

(52) U.S. Cl. ..... 336/90; 336/92; 336/96

(58) Field of Classification Search ..... 336/92, 336/96, 90

See application file for complete search history.

(56) References Cited

U.S. PATENT DOCUMENTS 5,349,320 A * 9/1994 Suzuki et al. ..... 336/92
5,781,092 A * 7/1998 Nakamichi et al. ..... 336/96
2003/0189476 A1* 10/2003 Nagata et al. ..... 336/90

FOREIGN PATENT DOCUMENTS

JP 6-112069 A 4/1994
JP 08017657 A * 1/1996

* cited by examiner

*Primary Examiner*—Anh T. Mai
(74) *Attorney, Agent, or Firm*—Sughrue Mion, PLLC

(57) ABSTRACT

An ignition coil is so constructed that a transformer which includes a center core wound with a primary coil and a secondary coil, and a side core is fixed to a case by an insulating resin, and a core cover formed of material adherable to the insulating resin and a core cover formed of material releasable from the insulating resin are provided between the side core and the secondary coil.

9 Claims, 4 Drawing Sheets

IGNITION COIL

BACKGROUND OF THE INVENTION

1. Field of the Invention

The present invention relates to an ignition coil which is used mainly in an internal combustion engine for a vehicle.

2. Description of the Related Art

The ignition coil includes a transformer which is formed by arranging a primary coil, a secondary coil outside the primary coil, and a center core inside the primary coil. A side core provided outside the center core constitutes a magnetic circuit in combination with the center core. After these components have been contained in a case and connected to interior parts of a vehicle by means of a connector assembly for connection with a vehicle harness, they are fixed and insulated by an insulating resin. Generally, electromagnetic steel plates are employed for making the center core and the side core, and thermosetting resin such as epoxy resin is employed as the insulating resin. The case is provided with an output terminal, which is connected to an ignition plug of an internal combustion engine by way of a high voltage cord.

In the ignition coil so constructed as described above, supply and disconnection of a primary current passed through the primary coil is controlled by control signals from a control unit in the internal combustion engine, by way of the connector assembly. When the primary current passed through the primary coil is cut off by the control signal at a determined ignition timing of the internal combustion engine, a counter electromotive force is generated in the primary coil, and high electric voltage is generated in the secondary coil. The generated high voltage is inputted to the ignition plug of the internal combustion engine which is connected by way of the high voltage cord.

[Patent Document 1] Japanese Patent Publication No. JP-A-6-112069

The side core formed of the electromagnetic steel plate exists in the insulating resin which has a different coefficient of linear expansion, and distortion may occur in the insulating resin when a thermal stress has been applied. In case where the thermal stresses have been repeatedly applied, an abrasion or a crack may occur in the insulating resin. Under the circumstances, the crack of the insulating resin starting from the side core has been prevented by mounting a core cover on the side core. However, the crack in the insulating resin which has occurred in the side core may exert bad influence on those components which are faced with the side core. For example, there is such probability that distortion may occur in the secondary coil (especially, in its bobbin), around the bobbin of the secondary coil which is located at a position close to the side core, and formed of material having high adherence to the insulating resin. The abrasion or crack which has occurred as the results will be a cause of an internal leak, and the distortion will be a cause of a break of the coil. Therefore, it has been a problem that this may lead to such a phenomenon that output voltage of the ignition device for the internal combustion engine is lowered or not at all generated.

SUMMARY OF THE INVENTION

According to the invention, there is provided an ignition coil including a transformer which includes a primary coil, a secondary coil, and a center core provided inside the primary coil, a side core provided outside the secondary coil and adapted to return a magnetic flux generated in the center core, a cover provided around the side core, a case for containing these components, and an insulating resin for fixing the components inside the case, characterized in that the cover includes a core cover formed of material adherable to the insulating resin and a core cover formed of material releasable from the insulating resin.

According to this invention, because the cover includes the core cover of the material adherable to the insulating resin and the core cover of the material releasable from the insulating resin to the contrary, buffer action will be made by a part which can be easily released from the insulating resin, the abrasion or crack of the insulating resin in a required part can be prevented, the distortion of the components can be moderated, and hence, it is possible to provide the ignition coil which is durable and highly reliable.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Embodiment 1

Figure 1:
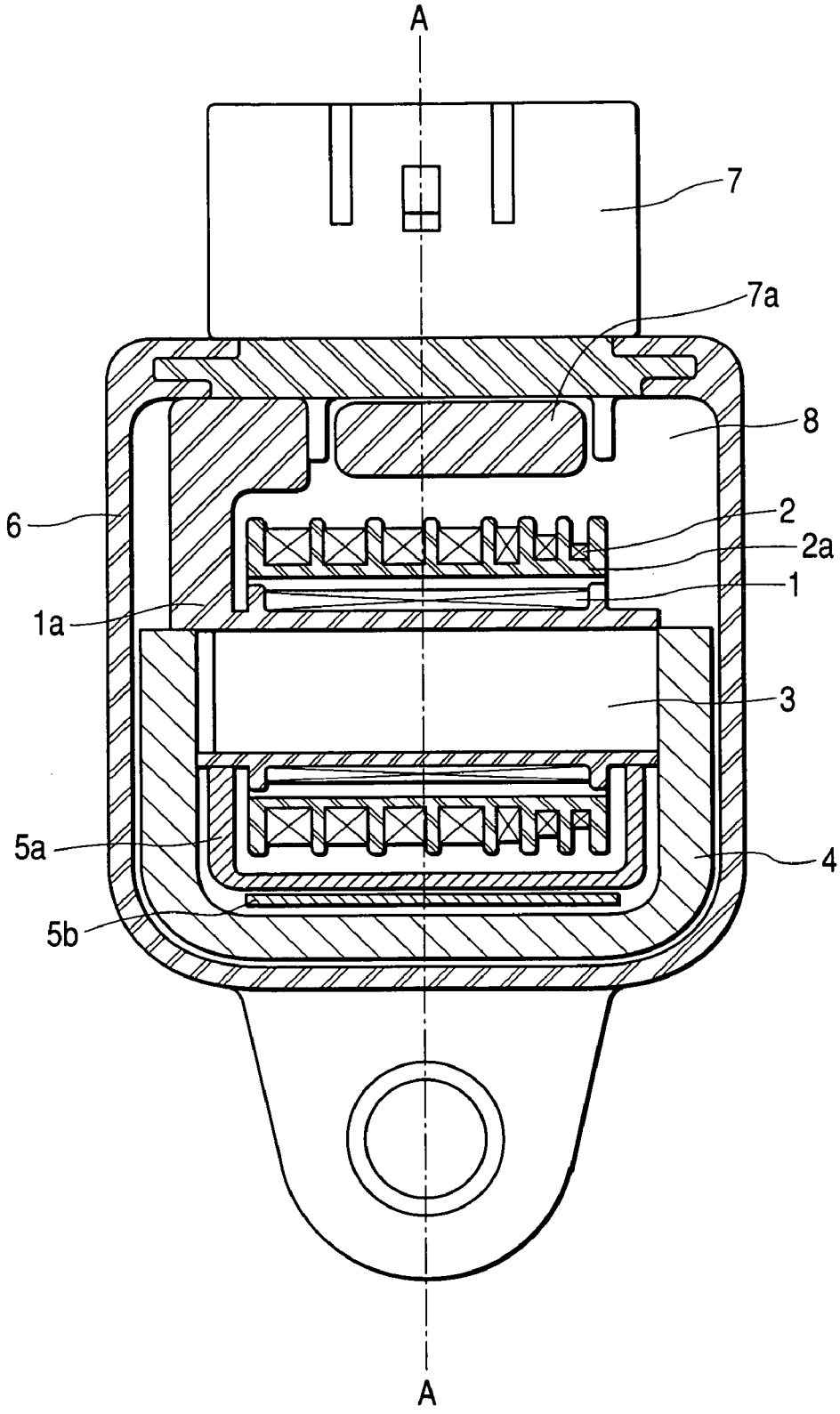
FIG. 1 is a sectional view showing an entire structure of an ignition coil in Embodiment 1 of the invention.
Figure 2:
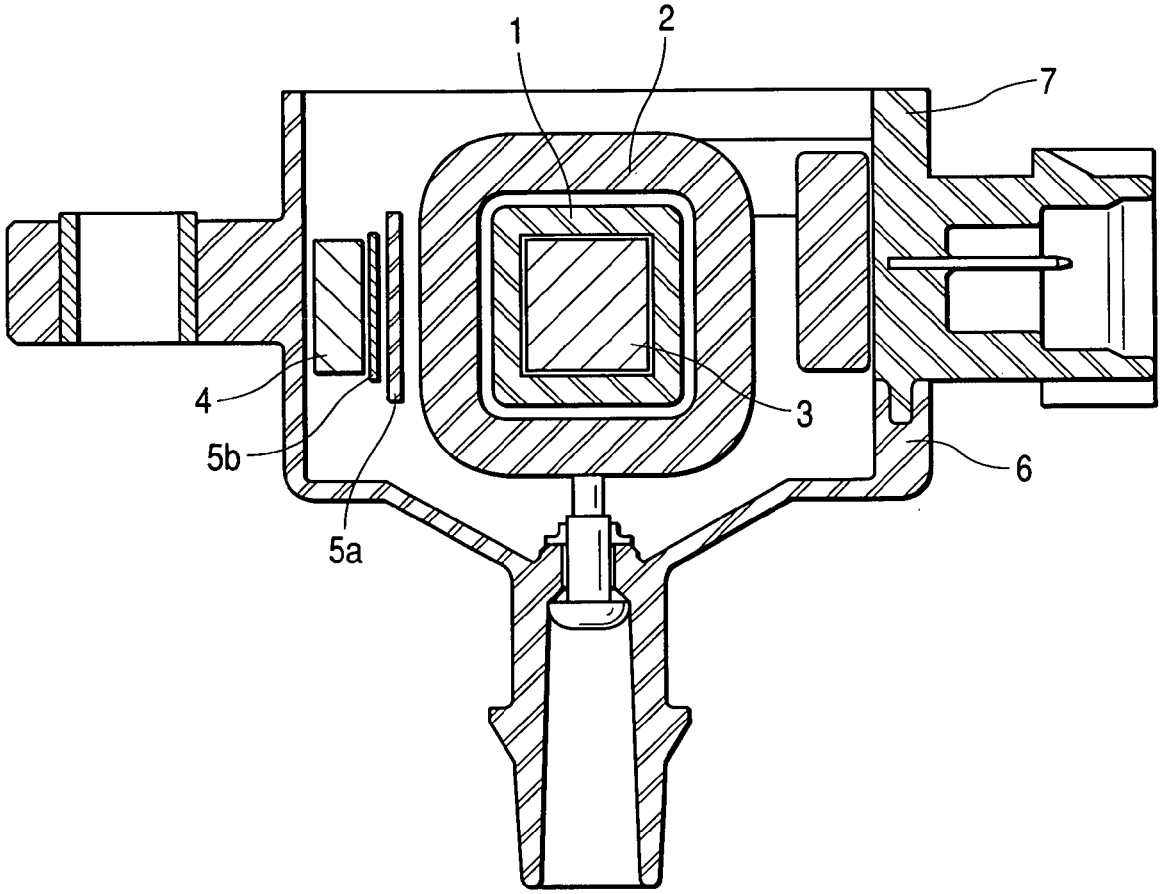
FIG. 2 is a schematic view showing an essential part of the ignition coil in Embodiment 1 of the invention.

Now, Embodiment 1 of the invention will be described. FIG. 1 is a plan view of an ignition coil, FIG. 2 is a sectional view taken along a line A—A in FIG. 1. A transformer including a primary coil 1, a secondary coil 2, and a center core 3, a side core 4, and a cover 5 provided around the side core 4 are encased in a case 6 which is in a shape of container and formed of resin. These components are respectively electrically connected by means of a connector assembly 7, and fixed by filling an insulating resin 8 formed of thermosetting epoxy resin. The connector assembly 7 is provided with connectors for connection with a vehicle harness (not shown), terminals for connection between the components, and a switching module 7*a* which supplies or cuts off a primary current passed through the primary coil 1 according to a control signal from a control unit (not shown). The cover 5 includes a core cover 5*a* formed of material adherable to the insulating resin 8 and a core cover 5*b* formed of material releasable from the insulating resin 8.

As the core cover 5*a* formed of the material adherable to the insulating resin 8, PBT resin is employed in the same manner as bobbins 1*a*, 2*a* of the primary coil 1 and the secondary coil 2. The core cover 5*a* is fixed to the bobbin 1*a* of the primary coil 1, and adhered in tight fit to the insulating resin 8 which is filled between the secondary coil 2 and the core cover 5*a*. The core cover 5*b* formed of the material releasable from the insulating resin 8 is formed of silicone resin, and arranged between the side core 4 and the core cover 5*a*. The insulating resin 8 flows into respective gaps between the core cover 5*b* and the side core 4, between the core cover 5*b* and the core cover 5*a*, and between the core cover 5*a* and the secondary coil 2, and forms thin layers of the insulating resin 8 after hardened. With this arrangement, in case where a thermal stress has been applied, the core cover 5*b* in a form of a releasable layer functions as a buffer member to restrain a crack of the insulating resin 8 starting from the side core 4. It is also possible to buffer a distortion of the component (the secondary coil 2) which is faced with the side core 4. As the results, a product having high reliability can be obtained.

Even though intervention of the insulating resin 8 is changed from such arrangement of the side core 4, the insulating resin 8, the core cover 5*b*, the insulating resin 8, the core cover 5*a*, the insulating resin 8, and the secondary coil 2, the same effects can be attained. Specifically, even a structure in which the core covers 5*a* and 5*b* are in contact with each other without intervention of the insulating resin 8, and further, a structure in which the side core 4 and the core cover 5*b* are in contact with each other can attain substantially the same effects. In other words, provided that the side core 4, the releasable material, the adherable material, and the secondary coil 2 are arranged in this order, the insulating resin would have crack preventing function, even though the insulating resin exists at any position between them.

Figure 3:
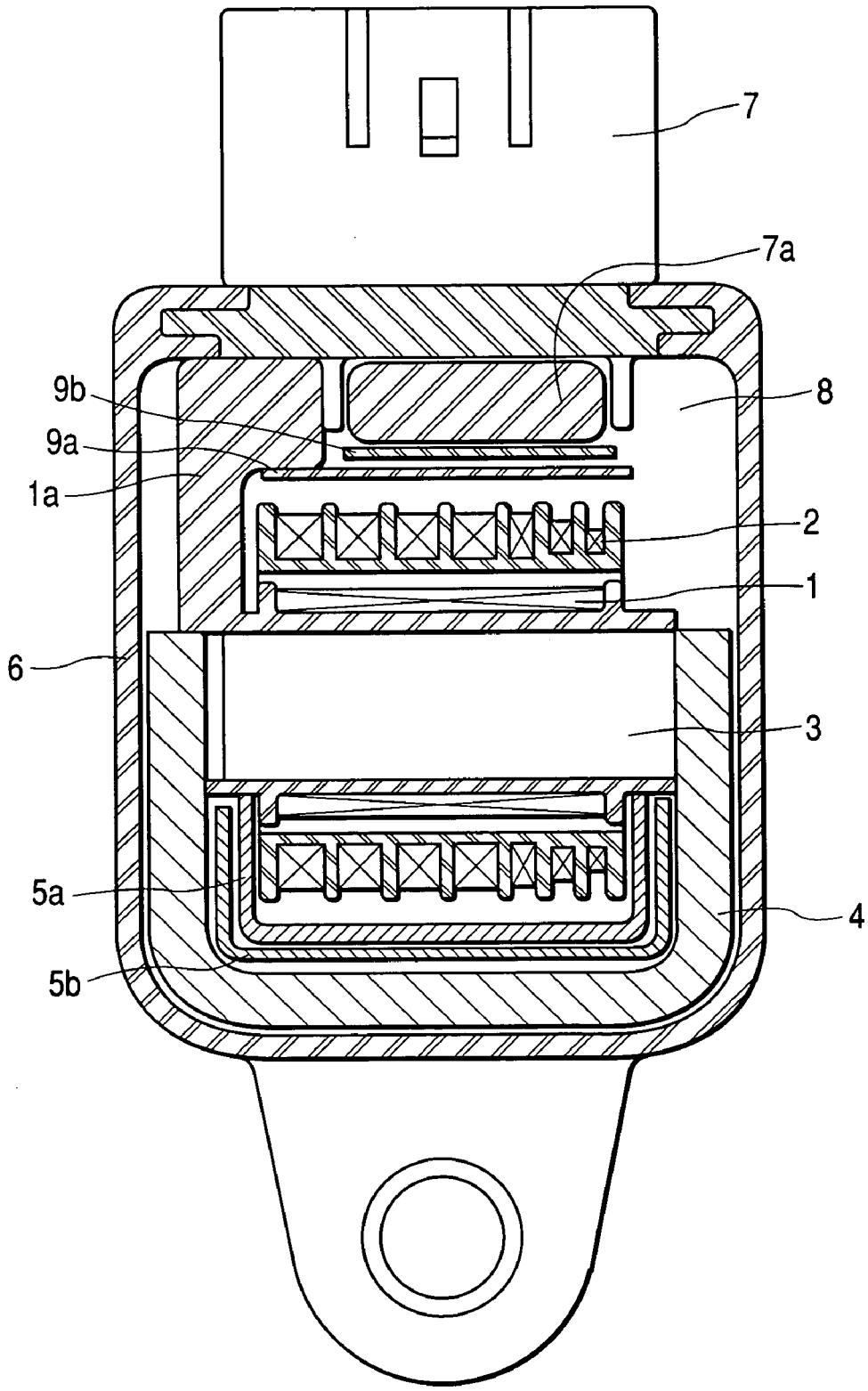
FIG. 3 is a schematic view showing an essential part of the ignition coil in Embodiments 1 and 2 of the invention.

In FIG. 2, the core cover 5*a* of the material adherable to the insulating resin 8 has a substantially C-shape in section so as to cover the bobbin 2*a* of the secondary coil 2. In FIG. 3, the core cover 5*b* of the releasable material also has a substantially C-shape, and can exert its performance more effectively by taking a similar shape to the adherable material. Moreover, the cover may be arranged between the side core 4 and the case 6 to attain the same effects, and can restrain occurrence of a crack. Although the center core 3 and the side core 4 are designed respectively in a substantially I-shape and in a substantially C-shape, they are not restricted to these shapes, but the cores may have two C-shapes or two E-shapes Further, the cores need not necessarily have a structure of a closed magnetic path. It is needless to say that the invention can be applied also to an ignition coil having the structure of an open magnetic path, provided that the cores having different coefficients of linear expansion are provided around the secondary coil, and covered with the insulating resin.

Embodiment 2

Then, Embodiment 2 will be described referring to FIG. 3. In case where a component which is provided between the case 6 and the secondary coil 2 at a position interposing the insulating resin 8 has a different coefficient of linear expansion from the insulating resin 8, a cover can be arranged around the component. This arrangement can be widely applied for example, to a cover for the switching module 7*a*. Numeral 9*a* in FIG. 3 represents a cover formed of the material adherable to the insulating resin, and numeral 9*b* represents a cover formed of the releasable material. The cover 9*a* of the material adherable to the insulating resin is arranged adjacent to the secondary coil 2, and the cover 9*b* of the releasable material is arranged adjacent to the switching module 7*a*. Accordingly, it would be advantageously attained that a crack of the insulating resin adjacent to the secondary coil can be prevented, and at the same time, stress on the switching module due to distortion of the insulating resin can be moderated. Moreover, a part of the cover 9*a* of the adherable material is engaged with the bobbin 1*a* in this embodiment, taking workability into consideration. Alternatively, the cover may be in a shape of bag which covers the whole body of the switching module.

Embodiment 3

Figure 4A:
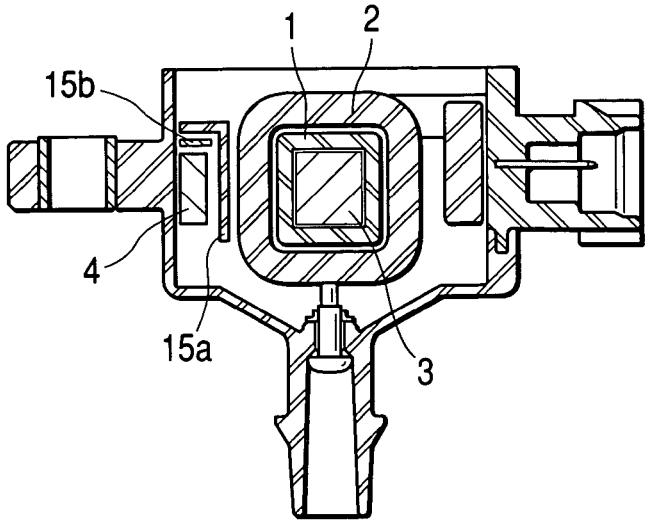
FIGS. 4A to 4C are schematic views showing an essential part of the ignition coil in Embodiment 3 of the invention.
Figure 4B:
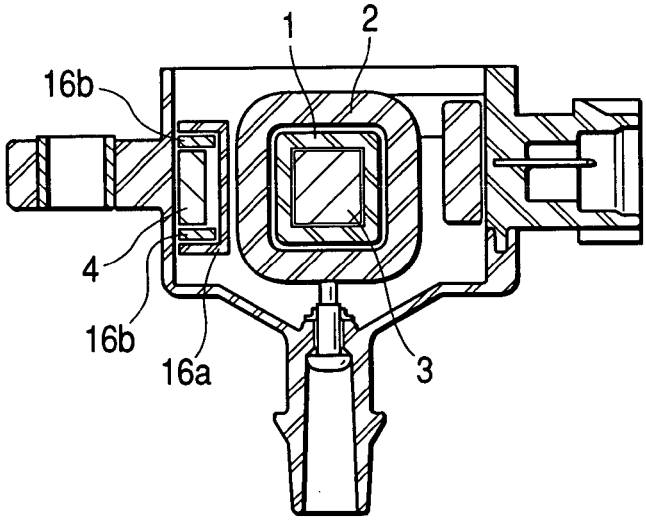
Figure 4C:
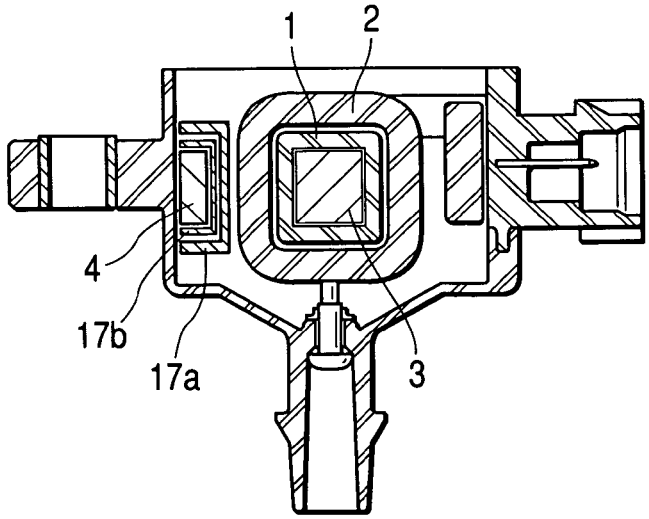

Then, Embodiment 3 will be described referring to FIGS. 4A to 4C. In FIG. 4A, a cover 15 is also arranged between the insulating resin adjacent to an opening face of the case 6 (in an upper part in the drawing) and the side core 4. The cover 15 includes, in the same manner as in the previous embodiments, a core cover 15*a* formed of the material adherable to the sinsulating resin, and a core cover 15*b* formed of the releasable material from the insulating resin. The core cover 15*a* of the adherable material is adhered also to the insulating resin adjacent to the opening face of the case 6. On the other hand, the core cover 15*b* of the releasable material from the insulating resin is formed of silicone resin, and arranged between the side core 4 and the core cover 15*a* of the adherable material. In the above described Embodiment 1, the core cover 5 is arranged between the side core 4 and the secondary coil 2, or the side core 4 and the case 6. This arrangement is called as a vertical arrangement, whereas the arrangement in Embodiment 3 is called as a lateral arrangement and is in a different direction.

In FIG. 4A, the core cover 15*a* is so designed as to cover at least two faces, in the drawing, of the side core 4, while the core cover 15*b* of the releasable material is provided between the core cover 15*a* and the side core 4. With such arrangement, the thermal stress due to a significant difference in the coefficient of linear expansion between the materials of the side core 4 and the insulating resin 8 can be moderated, and a crack of the insulating resin can be restrained.

Moreover, the core cover 15*b* of the releasable material is in a shape of sheet, and arranged between the side core 4 and the core cover 15*a* of the adherable material, in this embodiment. However, the core cover 15*b* of the releasable material may be integrally molded with the core cover 15*a* of the adherable material or the side core 4, or alternatively, may be provided with an engaging portion to be engaged with the side core 4. It is also possible to form the core cover 15*b* of the releasable material by sticking in a shape of tape painting silicone resin type paint. The releasable material to be employed in the core cover 15*b* of the releasable material is not limited to the silicone resin, but may include any material which can be easily released from the insulating resin 8, for example, rubber such as EPDM, fluorine resin, thermoplastic elastomer, and so on. By contrast, the adherable material may include any material having a molecular structure which is liable to be chemically bonded, for example, resin having carboxyl group (PET, PBT, UP, etc.) or resin blended with carboxyl group. Specification of the material may be applied also to Embodiments 1 and 2, in the same manner.

Although the core cover 15*b* of the releasable material is arranged adjacent to the opening face of the case, it is also possible to arrange the core cover 15*b* at an opposite side to the opening face of the case, or at both sides. FIG. 4B shows a structure in which the core cover 16*a* of the adherable material has a substantially C-shape and the two core covers 16*b* of the releasable material are arranged on two upper and lower faces of the side core 4. FIG. 4C shows a structure in which both the core cover 17*a* of the adherable material and the core cover 17*b* of the releasable material have a substantially C-shape so as to cover the side core 4.

This invention can be applied not only to the ignition coil for the internal combustion engine, but also to the ignition coils for ships, airplanes and so on which are used in an atmosphere containing heat, water, etc.

What is claimed is:

1. An ignition coil comprising:

a transformer which includes:

a primary coil;

a secondary coil; and a center core provided inside the primary coil;

a side core provided outside the secondary coil and adapted to return a magnetic flux generated in the center core, a cover provided around the side core;

a case for containing the primary coil, the secondary coil, the center core, the side core and the cover; and an insulating resin for fixing the primary coil, the secondary coil, the center core, the side core and the cover inside the case, wherein the cover includes a core cover formed of material adherable to the insulating resin and a core cover formed of material releasable from the insulating resin.

2. An ignition coil according to claim 1, wherein the cover is provided between the transformer and the side core.

3. An ignition coil according to claim 2, wherein the core cover of the releasable material is arranged adjacent to the side core, and the core cover of the adherable material is arranged adjacent to the transformer, and at least one layer of the insulating resin is filled between the side core and the transformer.

4. An ignition coil according to claim 2, wherein the core cover of the adherable material is held by the transformer.

5. An ignition coil according to claim 1, wherein the cover is provided between the insulating resin and the side core on at least one of an opening face of the case, a side opposite to the opening face of the case, and both the opening face of the case and the side opposite to the opening face of the case.

6. An ignition coil according to claim 1, wherein the core cover of the releasable material is held by the core cover of the adherable material, or by the side core.

7. An ignition coil according to claim 6, wherein the core cover of the releasable material is formed as a tape that is attached to the core cover of the adherable material or the side core.

8. An ignition coil according to claim 6, wherein the core cover of the releasable material is formed by being painted on the core cover of the adherable material or the side core.

9. An ignition coil according to claim 1, wherein the cover is formed by integrally molding the cover of the adherable material with the cover of the releasable material.

* * * * *